US010774854B2

(12) United States Patent
Yamauchi et al.

(10) Patent No.: US 10,774,854 B2
(45) Date of Patent: Sep. 15, 2020

(54) TUBE-FIXING TOOL AND ACTUATOR

(71) Applicant: Koganei Corporation, Koganei-shi, Tokyo (JP)

(72) Inventors: Takeshi Yamauchi, Koganei (JP); Hiraku Sakai, Koganei (JP)

(73) Assignee: KOGANEI CORPORATION, Tokyo (JP)

( * ) Notice: Subject to any disclaimer, the term of this patent is extended or adjusted under 35 U.S.C. 154(b) by 0 days.

(21) Appl. No.: 16/118,834

(22) Filed: Aug. 31, 2018

(65) Prior Publication Data

US 2019/0078590 A1 Mar. 14, 2019

(30) Foreign Application Priority Data

Sep. 11, 2017 (JP) ..... 2017-173672

(51) Int. Cl.
*F15B 15/10* (2006.01)

(52) U.S. Cl.
CPC ..... *F15B 15/103* (2013.01)

(58) Field of Classification Search
CPC ..... F15B 15/103; F15B 15/1438; F16L 33/01; F16L 33/225
See application file for complete search history.

(56) References Cited

U.S. PATENT DOCUMENTS 388,915 A * 9/1888 Pratt ..... F16L 33/01 285/222.1
2,809,056 A * 10/1957 Kaiser ..... F16L 33/01 285/222.2
2,844,126 A * 7/1958 Gaylord ..... F15B 15/103 92/90
3,118,691 A * 1/1964 Press ..... F16L 33/01 285/222.1
4,733,603 A * 3/1988 Kukolj ..... F15B 15/103 92/153
4,875,717 A * 10/1989 Policelli ..... F16L 47/04 285/222.1
4,974,497 A * 12/1990 Krauter ..... F15B 15/103 254/93 R (Continued)

FOREIGN PATENT DOCUMENTS

EP 1172567 A1 * 1/2002 ..... F15B 15/103
JP H0328507 A 2/1991
JP 2002541410 A 12/2002

*Primary Examiner* — Michael Leslie
*Assistant Examiner* — Matthew Wiblin
(74) *Attorney, Agent, or Firm* — McCormick, Paulding & Huber PLLC

(57) ABSTRACT

A tube-fixing tool is improved in assembling property between the tube-fixing tool and the elastic tube, and in production yield of the actuator. A tube-fixing tool is attached to an end of an elastic tube provided with: a soft tube and a cover tube, the soft tube constituting an actuator, the tube-fixing tool comprising: a fixing-tool body having a fitting-cylinder part provided with: a fitting-inner face that is fitted to an outer face of the soft tube; and a fitting-outer face that is fitted to an inner face of the cover tube; and a fixing sleeve having: an inner circumferential face that is opposed to the fitting-cylinder part via the cover tube; and a fastening part that is attached to the fixing-tool body, the cover tube being fixed between the fixing-tool body and the fixing sleeve.

6 Claims, 10 Drawing Sheets

(56) References Cited

U.S. PATENT DOCUMENTS

| | | | | |
|---|---|---|---|---|
| 5,031,301 | A * | 7/1991 | Oetiker | B21D 39/046 29/507 |
| 5,031,510 | A * | 7/1991 | Krauter | B25J 9/104 403/316 |
| 5,079,999 | A | 1/1992 | Negishi et al. | |
| 6,349,746 | B1 | 2/2002 | Bergemann et al. | |
| 7,222,887 | B2 * | 5/2007 | Schwarz | F15B 15/103 285/101 |
| 8,307,753 | B2 * | 11/2012 | Woods | B63B 1/248 92/92 |

* cited by examiner

TUBE-FIXING TOOL AND ACTUATOR

CROSS-REFERENCE TO RELATED APPLICATION

The present application claims priority from Japanese Patent Application No. 2017-173672 filed on Sep. 11, 2017, the content of which is hereby incorporated by reference into this application.

TECHNICAL FIELD OF THE INVENTION

The present invention relates to a tube-fixing tool to be attached to an elastic tube composed of: a soft tube and a cover tube formed on an outside of the soft tube, and an actuator having this tube-fixing tool.

BACKGROUND OF THE INVENTION

A hollow elastic tube is expanded and contracted in a radial direction thereof by a fluid supplied to and discharged from an inside of the elastic tube, and also extended and contracted in a length direction thereof. Patent document 1 discloses an actuating apparatus provided with: an elastic tube and head pieces serving as fixing tools to be attached to two ends thereof. This elastic tube is constituted by a hose main body and strands knitted inside the hose main body, that is, twisted yarns. The head piece is composed of: an inside part that is fitted to the inside of the elastic tube and an outside part that is fitted to the outside of the elastic tube, and each end of the elastic tube is fixed between the inside part and the outside part. An annular protrusion is formed on an outer circumferential face of the inside part so as to enhance a fastening force of the elastic tube by the outside part. This actuating apparatus is applicable as an actuator that carries out an extension and contraction operation and a bending operation by expanding and contracting the elastic tube by using a fluid.

A bendable actuator is disclosed in Patent document 2. This actuator is provided with: a tube-shaped member made of rubber or a rubber-state elastic member; and an elastic extension member composed of a net-shaped reinforcing structure, that is, a knitted strand structure, which is arranged around the outside thereof. Each end of the elastic extension member is fixed between a sealing member fitted to the elastic expansion member and a caulking ring attached to the outside of the elastic extension member. This actuator carries out an extension and contraction operation and a bending operation by expanding and contracting the elastic extension member by using a fluid supplied to and discharged from the tube-shaped member. There are two types in the actuator, that is, one type constituted by one elastic extension member, and another type constituted by a plurality of elastic extension members bound together.

PRIOR ART DOCUMENTS

Patent Documents

Patent Document 1: Japanese Translation of PCT International Application Publication No. 2002-541410

Patent Document 2: Japanese Unexamined Patent Application Publication No. H03-028507

As described in Patent documents 1 and 2, in a mode in which an inside part and a sealing member are fitted to the inside of a hose main body or an elastic extension member serving as an elastic tube, it is necessary to form a communication hole for use in supplying a fluid such as compressed air to the inside part or the like. Since the inside part is fitted to the elastic tube having a small diameter, the inside part to be fitted to the elastic tube cannot be made thicker, thereby causing an insufficient strength for fastening the outside part. For this reason, a conventional actuating apparatus and a actuator have a limited structure with a large inner diameter of an elastic tube, and none of the inside part and the sealing member are installed in an elastic tube having a small diameter.

The elastic extension member, that is, the elastic tube disclosed in Patent Document 2, is constituted by a tube-shaped member serving as an elastic tube made of an elastic member and a net-shaped reinforcing structure serving as a cover tube formed on the outside thereof, and has a two-layered structure or a stacked structure. In order to assemble an actuator by using the elastic extension member, a fixing tool made of a sealing member and a caulking ring is fixed to the end of the elastic extension member. Since both the tube-shaped member and the net-shaped reinforcing structure are elastically deformed, the thickness of the tube-shaped member corresponding to the portion of the fixing tool becomes thinner when the tube-shaped member is elastically deformed; therefore, the fixing strength of the tube-shaped member by the fixing tool is lowered. Therefore, when the elastic extension member having the stacked structure is fastened and fixed between the sealing member and the caulking ring, the elastic extension member might come off from the gap between the sealing member and the caulking ring by a fluid pressure supplied to the inside of the tube-shaped member, or the fluid might be externally leaked between the tube-shaped member and the sealing member.

For this reason, in order to improve the sealing property, an adhesive needs to be applied to the gap between the tube-shaped member and the sealing member. In order to further improve the sealing property between the tube-shaped member and the sealing member, the adhesive is applied to the gap between the entire outer circumferential face of the tube-shaped member and the sealing member, and the adhesive needs to be further applied to the gap between the net-shaped reinforcing structure and the caulking ring. Therefore, the conventional actuator encounters a problem that long time is required for applying process of the adhesive to cause a failure in improving the assembly workability of the actuator. Moreover, when the application of the adhesive is incomplete, a defective product tends to be produced, thereby causing a failure in enhancing a production yield of the actuator.

An object of the present invention is to improve the assembly workability of a tube-fixing tool to an elastic tube, and also to improve the production yield of an actuator.

SUMMARY OF THE INVENTION

According to one aspect of the present invention, there is provided a tube-fixing tool to be attached to an end of an elastic tube provided with a soft tube and a cover tube that is formed on an outside of the soft tube, the tube-fixing tool comprising: a fixing-tool body having a fitting-cylinder part provided with: a fitting-inner face that is fitted to an outer face of the soft tube; and a fitting-outer face that is fitted to an inner face of the cover tube, the fitting-cylinder part being assembled between the soft tube and the cover tube; and a fixing sleeve having: an inner circumferential face that is opposed to the fitting-cylinder part via the cover tube; and a fastening part that is attached to the fixing-tool body, the cover tube being fixed between the fixing sleeve and the fixing-tool body.

According to another aspect of the present invention, there is provided an actuator comprising: an elastic tube has: a soft tube; and a cover tube that is formed on an outside of the soft tube; and a tube-fixing tool that is formed on an end of the elastic tube, wherein the actuator is extended and contracted by an elastic deformation in a radial direction of the elastic tube by a fluid supplied to or discharged from an inner space of the elastic tube.

Effects of Invention

The tube-fixing tool has: a fitting-cylinder part having a fitting-inner face; and a fitting outer surface, and is attached to an end of an elastic tube having a soft tube and a cover tube formed on the outside of the soft tube. An outer surface of the soft tube is fitted to the fitting-inner face and the inner face of the cover tube is fitted to the fitting outer surface. When fluid is supplied to the inner space of the elastic tube, the soft tube is tightly made in contact with the fitting-inner face of the soft tube by pressure of fluid so that fluid is prevented from externally leaking. A tube-fixing tool to be attached to the end of the elastic tube is not provided with a member to be inserted to the inside of the elastic tube, and the elastic tube having a small diameter is attachable to the tube-fixing tool. In this manner, an actuator having a small diameter can be easily assembled.

It is not necessary to apply an adhesive to the gap between the soft tube and the fitting-inner face so as to improve the sealing property between the elastic tube and the tube-fixing tool, so that the actuator can be improved in assembly workability. Moreover, no defective product is caused by an incomplete adhesive applying process, so that it becomes possible to improve the production yield of the actuator.

DESCRIPTION OF THE PREFERRED EMBODIMENTS

Hereinafter, one or more embodiments of the present invention will be described with reference to the drawings, and common members the same as each other in the following embodiments and examples are denoted by the same reference number.

Figure 1A:
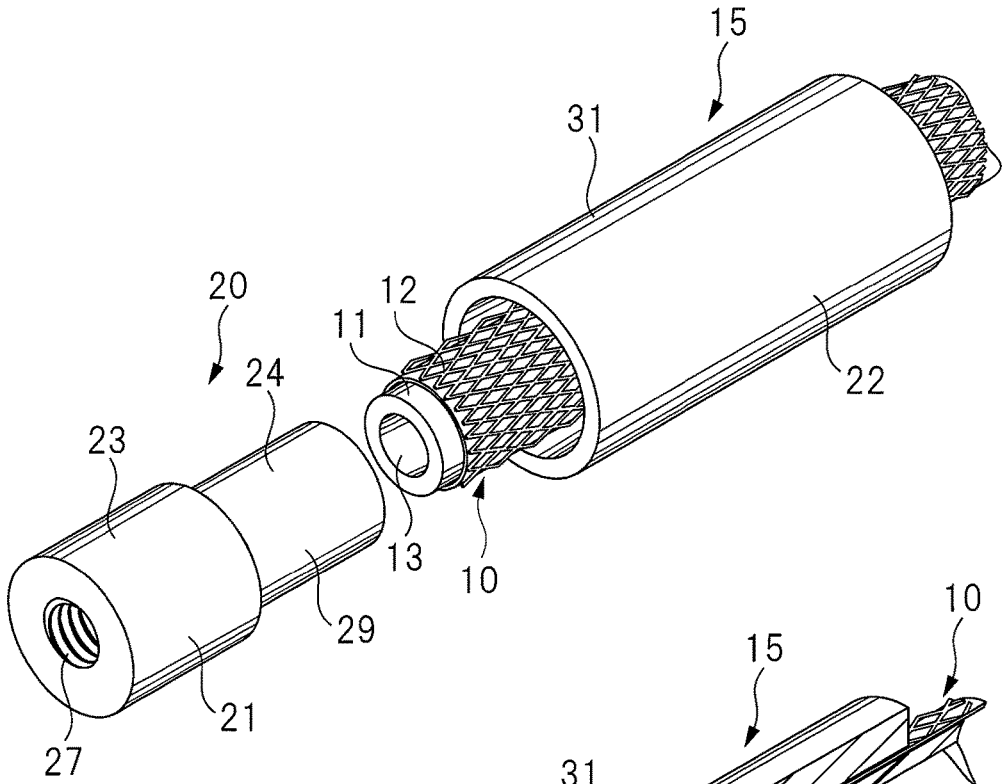
FIG. 1A is an exploded perspective view showing a tube-fixing tool serving as one embodiment for assembling an actuator.
Figure 1B:
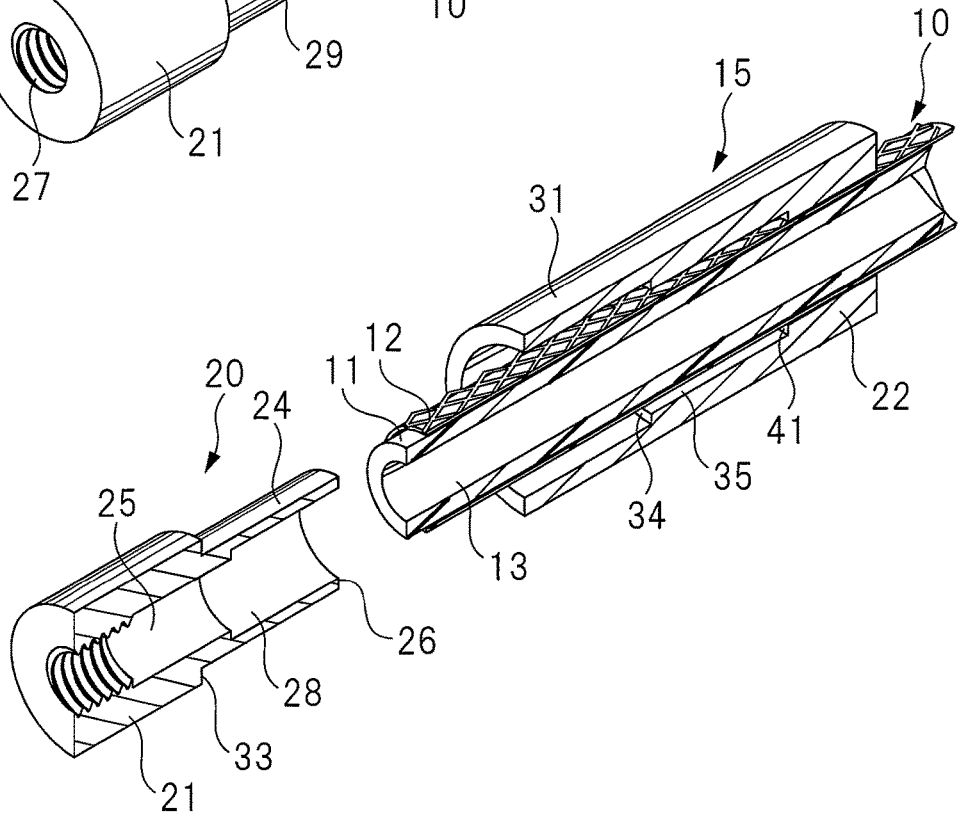
FIG. 1B is an exploded perspective view showing a cross section of FIG. 1A.

As shown in FIGS. 1 and 2, an actuator 15 is assembled from an elastic tube 10 and a tube-fixing tool 20 that is attached to an end of the elastic tube 10.

The elastic tube 10 has: a soft tube 11 and a cover tube 12 that is installed on an outside of the soft tube, and the elastic tube 10 is freely elastically deformed in a radial direction as well as in a length direction. The soft tube 11 is formed by using fluorine resin or silicon resin that is freely elastically deformable. As material for the soft tube 11, the soft tube 11 is not limited by these resins, and another synthetic resin, synthetic rubber or the like may be used as long as the material is freely elastically deformable. The soft tube 11 has a single-layered structure. On the other hand, it may have a stacked structure of layers made of the same material or different materials.

The cover tube 12 is a knitted strand tube having a net-shaped structure that is formed into a tube shape by knitting fibers made of polyester fibers, aromatic polyamide fibers or the like. The cover tube 12 is made in contact with the outside of the soft tube 11, and is not knitted into the soft tube 11. Moreover, the cover tube 12 is not bonded to the soft tube 11. One portion of the soft tube 11 is exposed onto the outside via gaps among the fibers forming the knitted strand tube. By forming the cover tube 12 on the outside of the soft tube 11, the elastic tube 10 is improved in strength. In place of the knitted strand tube having a single layer, another structure formed by stacking knitted strand tubes may be used as the cover tube 12. Moreover, materials formed by knitting wires made of metal and materials made of synthetic resin, synthetic rubber or the like and different from that of the soft tube 11 may be used as material for the cover tube 12. Furthermore, without forming the cover tube 12 as the knitted strand tube, a tube having gaps or holes that covers the entire outer surface of the soft tube 11 may be used.

Figure 2A:
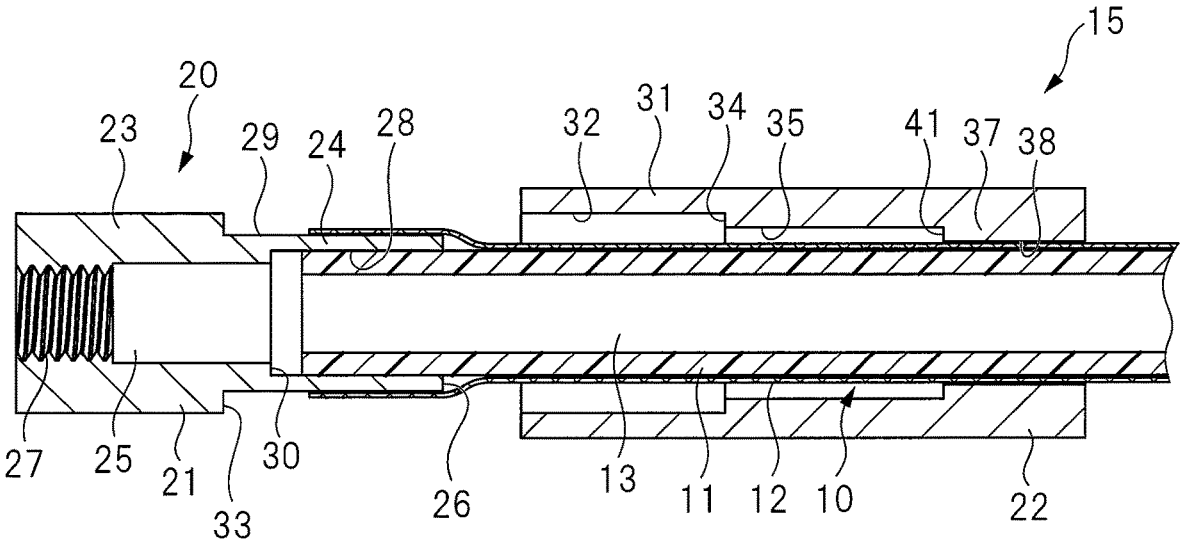
FIG. 2A is a cross sectional view showing the tube-fixing tool that is being attached to an elastic tube.
Figure 2B:
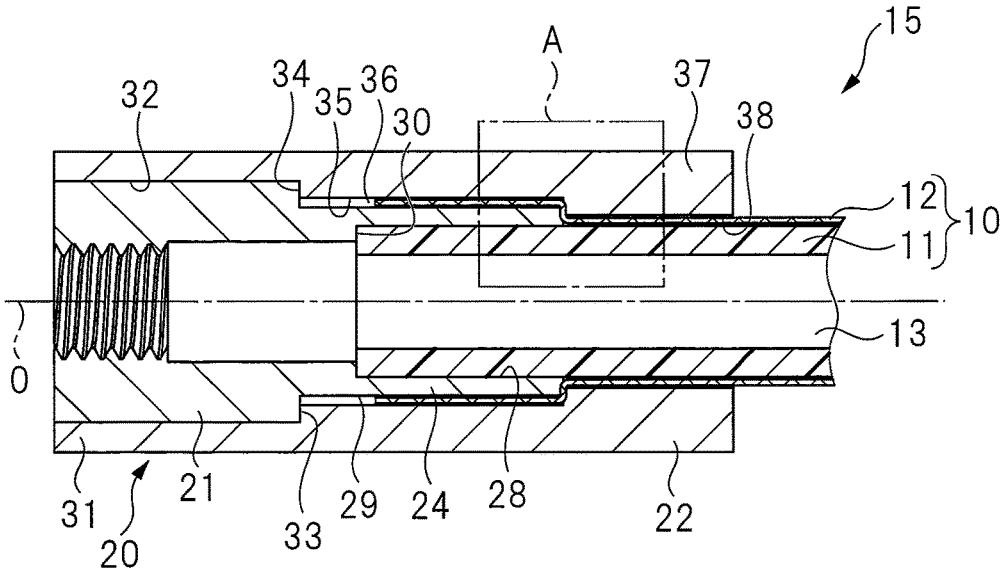
FIG. 2B is a cross sectional view showing the tube-fixing tool attached to the elastic tube.

As shown in FIG. 2B, the tube-fixing tool 20 is fixed to the end of the elastic tube 10 so that the actuator 15 is constituted by the elastic tube 10 and the tube-fixing tool 20. When compressed air is supplied to an inner space 13 of the soft tube 11 via the tube-fixing tool 20, the elastic tube 10 is expanded in a radial direction thereof and contracted in a length direction thereof.

For example, the actuator 15, which is formed by attaching the tube-fixing tool 20 to each end of the elastic tube 10, may be used for rocking an arm assembly body composed of two members that are coupled to each other by pins. In this use mode, the tube-fixing tool on one end side of the actuator 15 is attached to one of the members, and the tube-fixing tool on the other end side of the actuator 15 is attached to the other of the members. When a fluid such as compressed air or the like is supplied to or discharged from the inner space 13 from one or both of the tube-fixing tools, the elastic tube 10 is expanded and contracted so that the actuator 15 is expanded and contracted. In this manner, the actuator 15 can be used as an artificial muscle for use in rocking and driving the arm assembly body. In the actuator of a mode for supplying a fluid only from one of the tube fixing members, a closed structure is used as the other tube-fixing tool.

An actuator of a mode formed by binding the actuators 15 with one another may be used. In this case, tube-fixing tools formed on the ends of each actuator are bound with one another by fastening members as described in Patent Document 2. In this manner, in the actuator, there are a single type composed of a single actuator 15 and a bound type formed by binding a plurality of actuators 15 with one another.

The tube-fixing tool 20 has: a fixing-tool body 21; and a fixing sleeve 22 that is attached to the fixing-tool body 21. As shown in FIG. 2B, the fixing sleeve 22 is attached to the fixing-tool body 21, and the center axis "O" of the fixing sleeve 22 is coaxial with the center axis of the fixing-tool body 21. The fixing-tool body 21 and the fixing sleeve 22 are made of metal or hard resin. The fixing-tool body 21 has: an attaching part 23 disposed on the base end side; and a fitting-cylinder part 24 integrally formed with the attaching part 23 and disposed on the tip end side, and a communication hole 25 formed inside the fixing-tool body 21. The fitting-cylinder part 24 is a cylinder part smaller in diameter than that of the attaching part 23, and the tip face of the fitting-cylinder part 24 forms an opposing face 26 in a radial direction. A screw hole 27 is formed on the base end side of the communication hole 25, and a joint for use in connecting a hose or the like is screw-coupled to the screw hole 27. A fluid such as compressed air or the like supplied by the hose is supplied to the inner space 13 via the communication hole 25.

An inner face of the fitting-cylinder part 24 corresponds to a fitting-inner face 28 that is fitted to an outer face of the soft tube 11, and an outer face of the fitting-cylinder part 24 corresponds to a fitting-outer face 29 that is fitted to the inner face of the cover tube 12. The elastic tube 10 has a stacked structure composed of at least two layers of the soft tube 11 and the cover tube 12, the cover tube 12 is not bonded to the soft tube 11, and when the end of the cover tube 12 is elastically deformed in a radially outward direction of the soft tube 11, the end of the cover tube 12 is separated from the soft tube 11.

FIG. 2A shows a state in which the end of the cover tube 12 is expanded in a radially outward direction thereof, and the fitting-cylinder part 24 is inserted between the soft tube 11 and the cover tube 12. An abutment face 30 perpendicular to the center axis "O" is formed on the fixing-tool body 21, and the abutment face 30 forms a border face between the inner circumferential face of the communication hole 25 and the fitting-inner face 28. As shown in FIG. 2B, by causing the end face of the soft tube 11 to about on the abutment face 30, a position in axial direction of the fixing-tool body 21 relative to the soft tube 11 is determined.

A base end of the fixing sleeve 22 corresponds to a fastening part 31 that is attached to the attaching part 23 of the fixing-tool body 21. An outer face of the attaching part 23 has a round shape in lateral cross section, and an inner face 32 of the fastening part 31 also has a round shape in cross section. The inner face 32 has an inner diameter slightly smaller than the outer diameter of the attaching part 23, and the fastening part 31 of the fixing sleeve 22 is press-inserted into the attaching part 23 as shown in FIG. 2B so that the fixing sleeve 22 is fixed to the fixing-tool body 21 by the press-insertion. A first position-determining face 33 perpendicular to the center axis "O" forms a border face between the attaching part 23 of the fixing-tool body 21 and the fitting-cylinder part 24 smaller in diameter than the attaching part 23, and a second position-determining face 34 is formed on the fixing sleeve 22 so as to abut on the first position-determining face 33. By causing the second position-determining face 34 to abut on the first position-determining face 33, a position in axial direction of the fixing sleeve 22 relative to the fixing-tool body 21 is determined.

Figure 3:
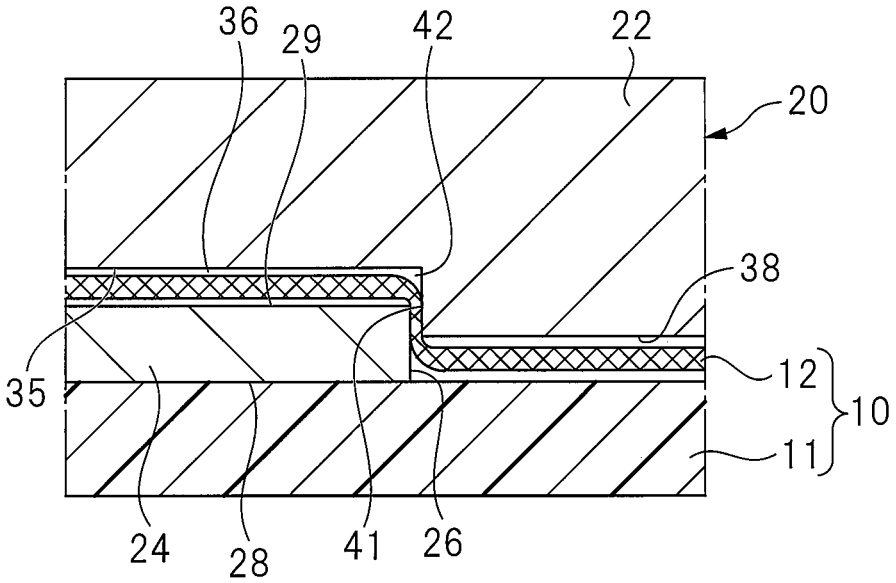
FIG. 3 is an enlarged cross sectional view showing a portion "A" in FIG. 2B.

A cylindrical inner circumferential face 35 is formed on the inner face of the fixing sleeve 22. Therefore, with the fixing sleeve 22 attached to the fixing-tool body 21, the inner circumferential face 35 is opposed to the fitting-cylinder part 24 via the cover tube 12. Moreover, a gap 36 formed between the inner circumferential face 35 and the fitting-outer face 29 of the fixing sleeve 22 is substantially the same as the thickness of the cover tube 12 or slightly larger than the thickness of the cover tube 12. A guide part 37 is provided to the tip end of the fixing sleeve 22, and the guide part 37 has a cylindrical guide face 38 that is smaller in inner diameter than the inner circumferential face 35, and the same as or slightly larger than an outer diameter of the elastic tube 10. In FIG. 3, the cover tube 12 is separated from the fitting-outer face 29 and the inner circumferential face 35, and the gap 36 is depicted in an exaggerated manner.

In this specification, the attaching part 23 of the fixing-tool body 21 is formed on the base end side of the fixing-tool body 21, and the fitting-cylinder part 24 is formed on the tip end side of the fixing-tool body 21. In the fixing sleeve 22, the fastening part 31 is formed on the base end side, and the guide part 37 is formed on the tip end side.

As shown in FIG. 3, a stopper face 41 is formed on the fixing sleeve 22, and the stopper face 41 is constituted by a border face between the inner circumferential face 35 and the guide face 38. The stopper face 41 is opposed to the opposing face 26 of the fitting-cylinder part 24. The stopper face 41 and the opposing face 26 are perpendicular to the center axis "O" of the tube-fixing tool 20. As shown in FIG. 3, a gap 42 is formed between the stopper face 41 and the opposing face 26, and the gap 42 has a width that is defined in a direction of the center axis of the gap 42 and smaller than the thickness of the cover tube 12. Therefore, the cover tube 12 is sandwiched in the gap 42 between the stopper face 41 and the opposing face 26, and the cover tube 12 is fixed to the fixing-tool body 21 by the gap 42. In this manner, the gap 42 between the stopper face 41 and the opposing face 26 is smaller than the gap 36 between the inner circumferential face 35 and the fitting-outer face 29.

The elastic tube 10 having the soft tube 11 and the cover tube 12 makes it possible to separate the cover tube 12 from the soft tube 11 at each end of the elastic tube 10. The outer circumferential face of the soft tube 11 is made in contact with the fitting-inner face 28 of the fitting-cylinder part 24, and in the cover tube 12, a portion closer to its tip end than a portion between the fitting-cylinder part 24 and the inner circumferential face 35 is tightened by the opposing face 26 and the stopper face 41 and fixed to the tube-fixing tool 20.

When compressed air is supplied to the inner space 13 from the outside, the soft tube 11 is tightly made in contact with the fitting-inner face 28 by pressure of compressed air supplied to the inner space 13. That is, by pressure of compressed air supplied to the inner space 13, the soft tube 11 is made tightly in contact with the fitting-inner face 28 by so-called "self-restraining action". In this manner, compressed air supplied to the inner space 13 is prevented from being leaked from between the fitting-inner face 28 and the soft tube 11, and prevented from being leaked to the outside from between the elastic tube 10 and the tube-fixing tool 20. In this manner, since the tube-fixing tool 20 does not have a member to be fitted to an inner face of the soft tube 11, the small-diameter soft tube 11 can be easily attached to the tube-fixing tool 20. Moreover, by making the outer circumferential face of the soft tube 11 tightly in contact with the fitting-inner face 28, it becomes possible to prevent leaking of compressed air.

Even if a force in an axial direction is applied to the elastic tube 10 so as to draw the elastic tube 10 from the tube-fixing tool 20, as shown in FIG. 3, the cover tube 12 is sandwiched between the stopper face 41 of the fixing sleeve 22 and the opposing face 26 of the fitting-cylinder part 24. In this manner, since the cover tube 12 is fixed to the fixing-tool body 21 by the fixing sleeve 22, the elastic tube 10 is prevented from coming off from the tube-fixing tool 20.

In this manner, the elastic tube 10 is fixed to the tube-fixing tool 20 by the cover tube 12, and by adhesion between the soft tube 11 and the fitting-inner face 28, a fluid inside the inner space 13 is prevented from leaking.

The actuator 15 is assembled from the above elastic tube 10 and the tube-fixing tool 20 to be attached to the end of the elastic tube 10. The actuator 15 is fixed to a driven member (not shown) via the tube-fixing tool 20. A fluid supply source for supplying a fluid such as compressed air or the like is connected to the fixing-tool body 21, and the fluid is supplied to the inner space 13 via the communication hole 25. By the fluid supplied to or discharged from the inner space 13, the elastic tube 10 is expanded and contracted in a radial direction, and the actuator 15 is deformed by expanding and contracting the elastic tube 10. The driven member can be driven by this expanding and contracting deformation. The elastic tube 10 has: a portion located so as to face the guide face 38; and a portion located outside the tube-fixing tool 20. When the elastic tube 10 is expanded in a radial direction, the expansion in the radial direction of the elastic tube 10 inside the guide face 38 is regulated by the guide face 38, while the expansion in the radial direction of the elastic tube 10 located outside the tube-fixing tool 20 is not regulated. Since the elastic tube 10 inside the guide face 38 is not tightened by the guide part 37, the elastic tube 10 inside the guide face 38 is elastically deformed in accordance with the expansion of the elastic tube 10 located outside the tube-fixing tool 20.

By attaching the tube-fixing tool 20 to both ends of the elastic tube 10, a fluid can be supplied to the inner space from both ends of the elastic tube 10. On the other hand, by attaching one tube-fixing tool 20 to one end of the elastic tube 10, and by attaching another tube-fixing tool 20 having a blocked screw hole 27 to the other end of the elastic tube 10, the actuator can be operated by the fluid supplied or discharged from one end of the actuator 15 so as to extend and contract the actuator.

Since the elastic tube 10 is designed to have a small diameter, a small-sized actuator 15 having a small diameter can be assembled. In the actuator in a mode in which the elastic tubes 10 are bound together as well, by using the elastic tube 10 having a small diameter, the small-sized actuator 15 having a small diameter can be produced. Moreover, since it becomes possible to prevent leaking of fluid without applying adhesive between the soft tube 11 and the fitting-inner face 28, the actuator 15 can be improved in assembly workability. Furthermore, since it is not necessary to apply adhesive to the soft tube 11 and the fitting-inner face 28, it becomes possible to prevent leaking of fluid from being caused by application failure of adhesive, thereby improving the production yield of the actuator.

Since it is not necessary to prevent leaking of fluid between the inner circumferential face 35 and the fitting-outer face 29, and since the cover tube 12 is housed between the inner circumferential face 35 and the fitting-outer face 29, the cover tube 12 may be bonded to the tube-fixing tool 20 by applying an adhesive between these faces.

Figure 4A:
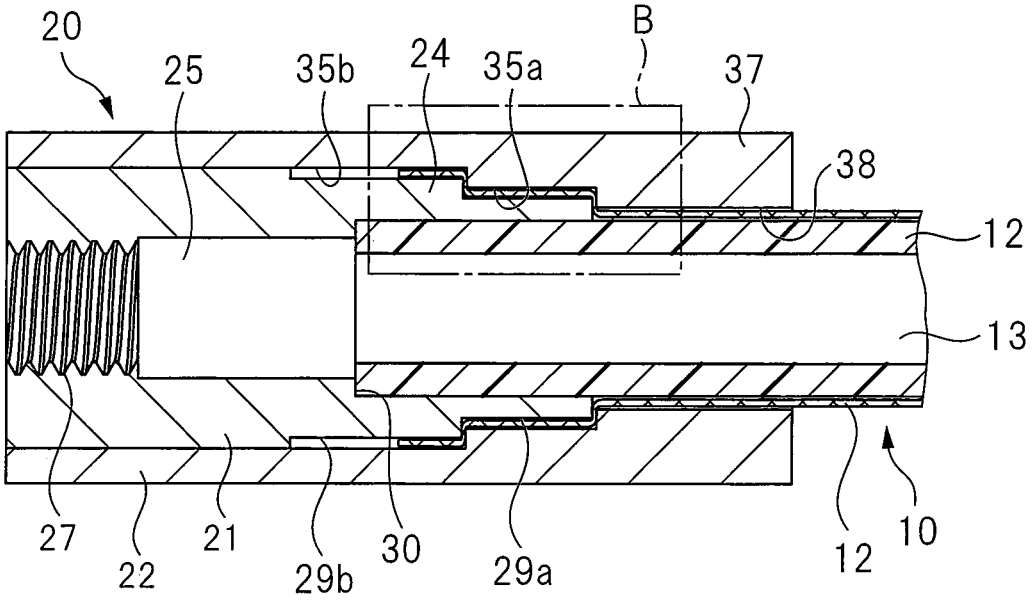
FIG. 4A is a cross sectional view showing a tube-fixing tool of a modified example.
Figure 4B:
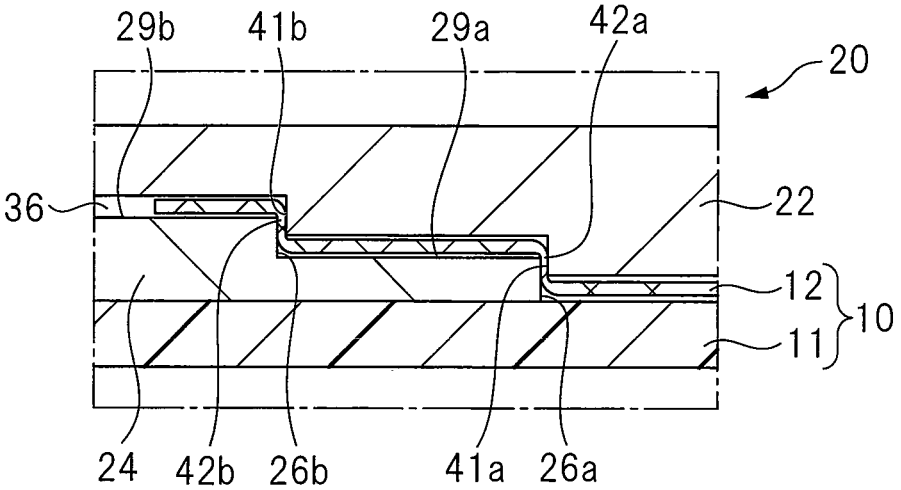
FIG. 4B is an enlarged cross sectional view showing a Portion "B" of FIG. 4A.

FIG. 4A is a cross sectional view showing a tube-fixing tool of a modified example, and FIG. 4B is an enlarged cross sectional view showing a Portion "B" of FIG. 4A.

As shown in FIG. 4, a first fitting-outer face 29*a* and a second fitting-outer face 29*b* are formed on the fitting-cylinder part 24. The first fitting-outer face 29*a* is disposed on the tip end side of the fixing-tool body 21, and the second fitting-outer face 29*b* is disposed on the base end side of the fixing-tool body, and larger in diameter than the first fitting-outer face 29*a*. In addition, a first inner circumferential face 35*a* and a second inner circumferential face 35*b* are formed on the fixing sleeve 22. The first inner circumferential face 35*a* is opposed to the first fitting-outer face 29*a*, and the second inner circumferential face 35*b* is opposed to the second fitting-outer face 29*b*, and larger in diameter than the first inner circumferential face 35*a*.

A first stopper face 41*a* forms a border face between the guide face 38 and the first inner circumferential face 35*a*. A second stopper face 41*b* forms a border face between the first inner circumferential face 35*a* and the second inner circumferential face 35*b*. The tip face of the fitting-cylinder part 24 corresponds to the first opposing face 26*a*, and the second opposing face 26*b* forms a border face between the first fitting-outer face 29*a* and the second fitting-outer face 29*b*. Therefore, in the tube-fixing tool 20 shown in FIG. 4, the cover tube 12 is sandwiched by a gap 42*a* between the first stopper face 41*a* and the first opposing face 26*a* and a gap 42*b* between the second stopper face 41*b* and the second opposing face 26*b*. In this manner, when the cover tube 12 is fixed to the fixing-tool body 21 by sandwiching the cover tube 12 at two portions by using the fixing sleeve 22, the fixing strength of the cover tube 12 can be improved. In this case, however, the cover tube 12 may be sandwiched by using only one of the gaps 42*a* and 42*b*.

Each of FIGS. 5A to 7A is an enlarged cross sectional view partially showing a tube-fixing tool of another modified example, and each of FIGS. 5B to 7A is an enlarged cross sectional view partially showing a tube-fixing tool of another modified example.

Figure 5A:
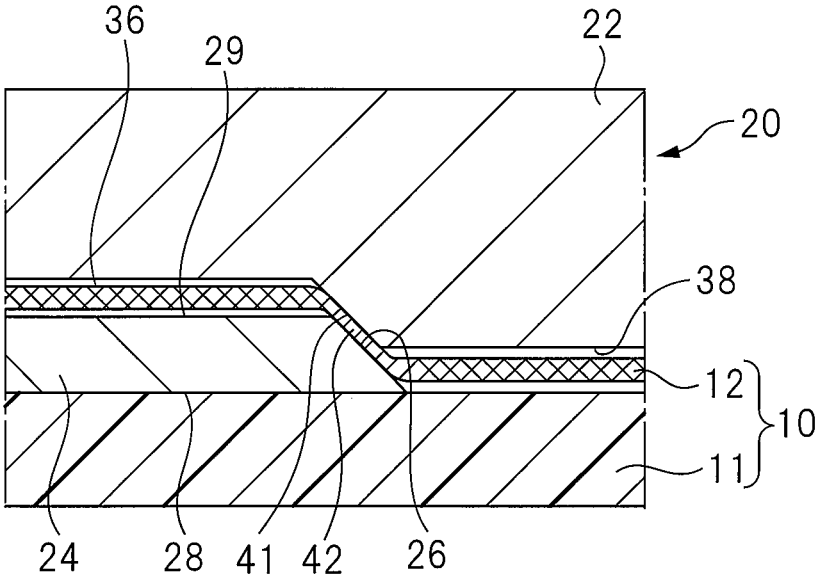
FIG. 5A is an enlarged cross sectional view partially showing a tube-fixing tool of another modified example.

In a tube-fixing tool 20 shown in FIG. 5A, the opposing face 26 formed on the opening end of the fitting-cylinder part 24 has a face tapered toward the tip face, and the opposing face 26 is inclined relative to the center axis "O" of the fixing-tool body 21. On the other hand, the stopper face 41 is inclined in a direction along the opposing face 26, and is opposed to the opposing face 26. The gap 42 formed between the opposing face 26 and the stopper face 41 has a width smaller than the thickness of the cover tube 12. Therefore, the cover tube 12 is sandwiched between the opposing face 26 and the stopper face 41 that respectively form inclined faces, and fixed to the fixing-tool body 21 by the fixing sleeve 22. In this manner, by inclining the gap 42, the gap 42 is becomes longer in length than that of FIG. 4.

Figure 5B:
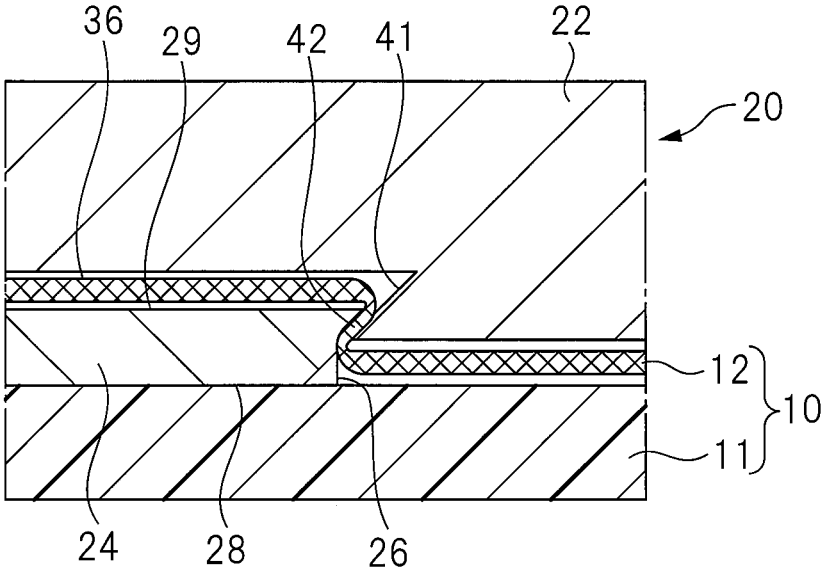
FIG. 5B is an enlarged cross sectional view partially showing a tube-fixing tool of another modified example.

In a tube-fixing tool 20 shown in FIG. 5B, the stopper face 41 is inclined in a reversed direction relative to the stopper face 41 shown in FIG. 5A. That is, the stopper face 41 has a reversed taper face. The opposing face 26 opposed to the stopper face 41 of the reversed taper face has a portion inclined along the stopper face 41, and the opposing face 26 also has a portion inclined in a reversed direction relative to the opposing face 26 shown in FIG. 5A. In this manner, by reversely inclining the gap 42, the cover tube 12 is fixed in a winding state, the fixing strength can be increased.

Figure 6A:
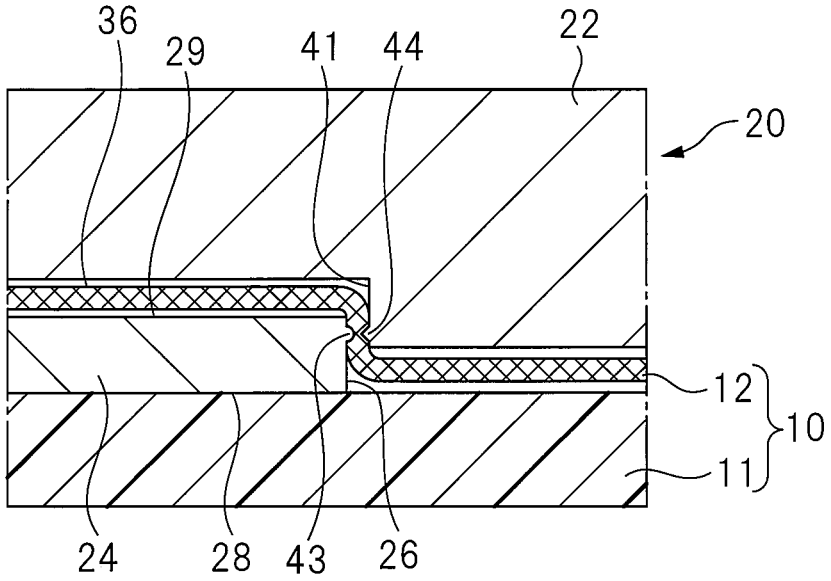
FIG. 6A is an enlarged cross sectional view partially showing a tube-fixing tool of another modified example.

In a tube-fixing tool 20 shown in FIG. 6A, a protruding part 43 is formed on the opposing face 26, and a protruding part 44 is formed on the stopper face 41. The protruding part 43 is opposed to the protruding part 44, and the cover tube 12 is firmly sandwiched between two protruding parts 43 and 44 in comparison with other portions. The protruding parts may be formed on both the opposing face 26 and the stopper face 41, or may be formed on at least one of them. The protruding part 43 is formed on the entire opposing face 26 in a radial direction so as to be connected annularly, and the protruding part 44 is formed so as to be connected annularly in the same manner. On the other hand, the protruding parts 43 and 44 may be formed so as to have intervals spaced in a circumferential direction. In this case, the protruding parts 44 may be formed in association with positions of the intervals of the protruding parts 43.

Figure 6B:
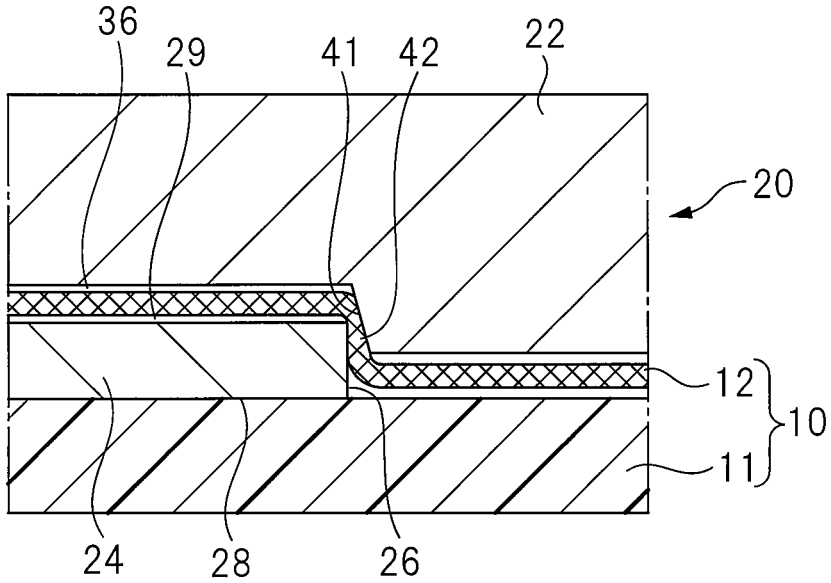
FIG. 6B is an enlarged cross sectional view partially showing a tube-fixing tool of another modified example.

In a tube-fixing tool 20 shown in FIG. 6B, the opposing face 26 extends in a perpendicular direction relative to the center axis "O" of the fixing-tool body 21, the stopper face 41 is not in parallel with the opposing face 26, but is inclined relative to the center axis "O". In this manner, by inclining the stopper face 41, the cover tube 12 is tightened inside a gap 42 narrowed in a radially outward direction, the fixing strength can be increased.

Figure 7A:
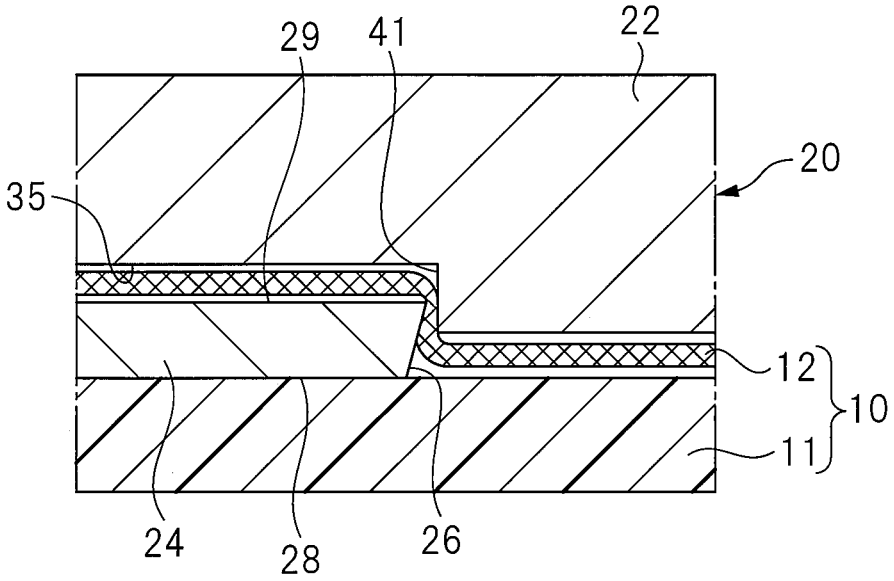
FIG. 7A is an enlarged cross sectional view partially showing a tube-fixing tool of another modified example.

In a tube-fixing tool 20 shown in FIG. 7A and different from that of FIG. 6B, the stopper face 41 extends in a perpendicular direction relative to the center axis "O" of the fixing-tool body 21, the opposing face 26 is not in parallel with the stopper face 41, but is inclined relative to the center axis "O". As shown in FIGS. 6B and 7A, by setting one of the opposing face 26 and the stopper face 41 in a perpendicular direction, and by inclining the other of the opposing face 26 and the stopper face 41 relative to the center axis "O", the fixing strength of the cover tube 12 relative to the fixing-tool body 21 can be increased.

In the above-mentioned respective embodiments, the protruding part shown in FIG. 6A may be formed on at least one of the opposing face 26 and the stopper face 41.

Figure 7B:
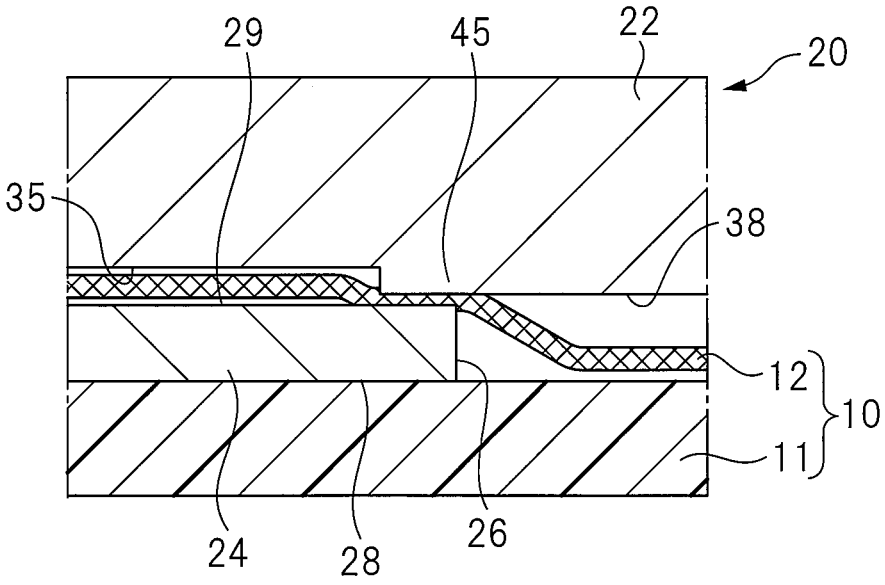
FIG. 7B is an enlarged cross sectional view partially showing a tube-fixing tool of another modified example.

In a tube-fixing tool 20 shown in FIG. 7B, the guide face 38 extends toward the base end side of the fixing sleeve 22, and the base end of the guide face 38 is opposed to the tip end of the fitting-cylinder part 24 in a radial direction thereof. A pressing part 45 is formed so as to press the cover tube 12 to the fitting-cylinder part 24 in a radially inward direction thereof by the guide face 38. In this manner, in the tube-fixing tool 20 shown in FIG. 7B, the fixing sleeve 22 presses the cover tube 12 to the fitting-cylinder part 24 in the radial inward direction, so that the cover tube 12 is tightened and fixed to the fixing-tool body 21.

FIGS. 5 to 7 each show the tube-fixing tool 20 shown in FIGS. 1 and 2, and each show a portion "A" shown in FIG. 2B, this structure can be applied to a mode provided with: a first fitting-outer face 29*a* and a second fitting-outer face 29*b*, as in the case of the tube-fixing tool 20 shown in FIG. 4. In this case, the cover tube 12 is provided with two fixing portions shown in FIGS. 5 to 7.

Figure 8:
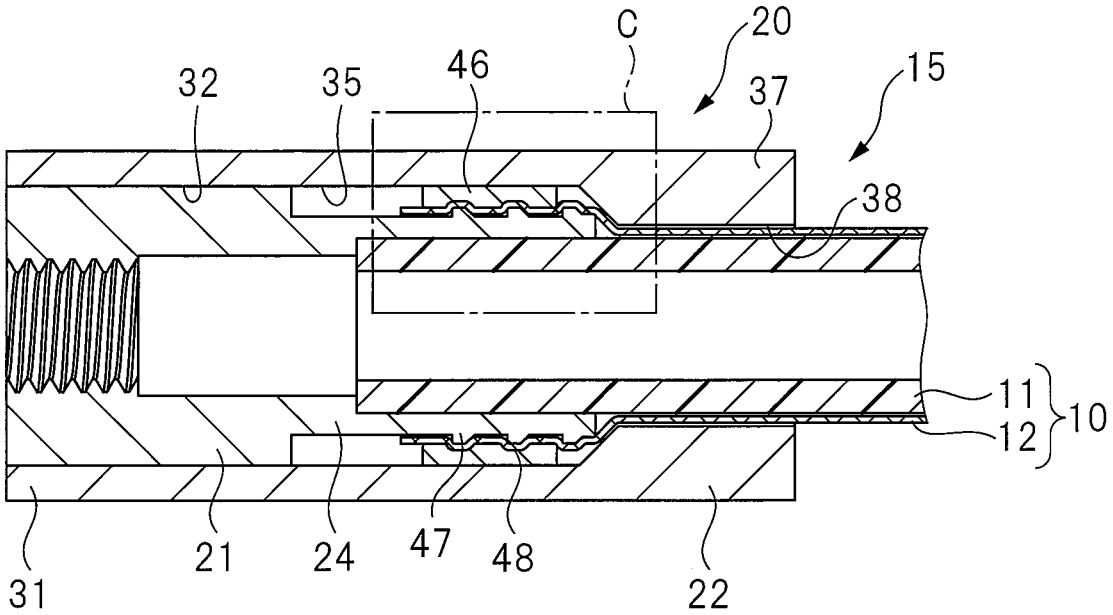
FIG. 8 is a cross sectional view showing a tube-fixing tool of another modified example.
Figure 9A:
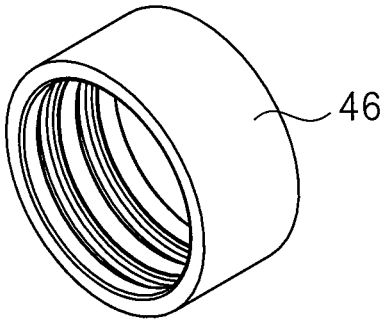
FIG. 9A is a perspective view showing a fixing ring shown in FIG. 8.
Figure 9B:
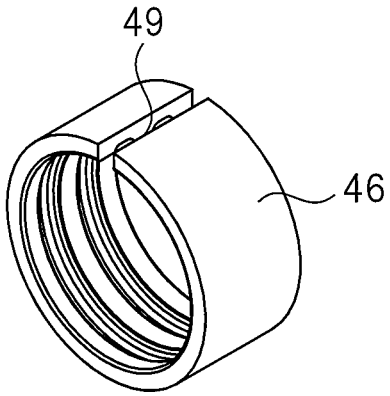
FIG. 9B is a perspective view showing a fixing ring serving as another modified example.

FIG. 8 is a cross sectional view showing a tube-fixing tool of another modified example; FIG. 9A is a perspective view showing a fixing ring shown in FIG. 8, and FIG. 9B is a perspective view showing a fixing ring serving as another modified example; and FIG. 10A is an enlarged cross sectional view showing a portion "C" in FIG. 8, and FIG. 10B is an enlarged cross sectional view partially showing a tube-fixing tool of another modified example.

Figure 10A:
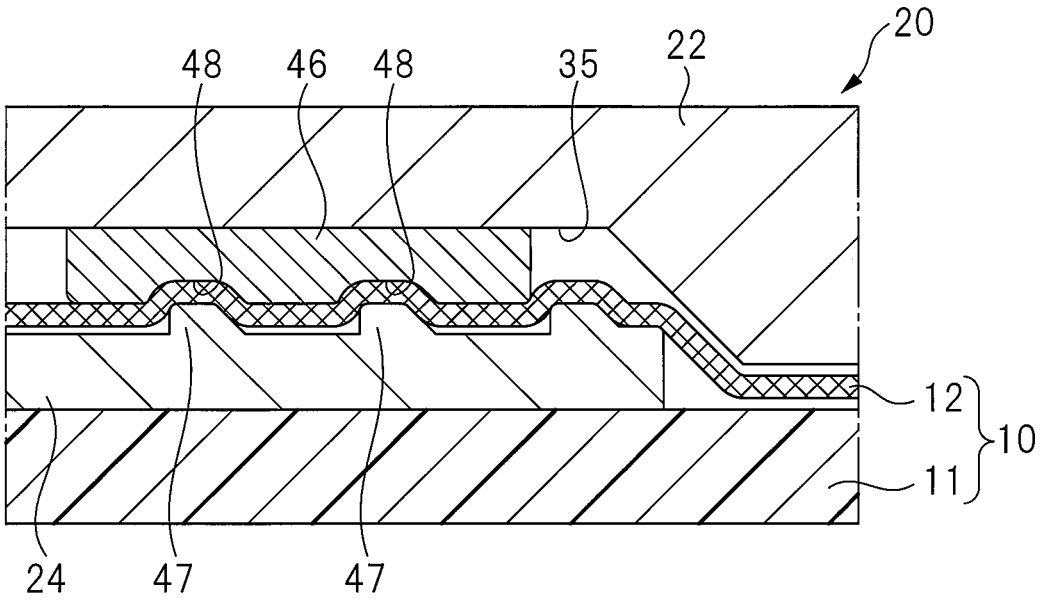
FIG. 10A is an enlarged cross sectional view showing a portion "C" in FIG. 8.

A tube-fixing tool 20 shown in FIGS. 8 and 10A has a fixing ring 46 that is fitted to the inner circumferential face 35 of the fixing sleeve 22, and the fixing ring 46 is disposed on the outside of the fitting-cylinder part 24 via the cover tube 12. A plurality of convex parts 47 protruding in the radially outward direction are formed on the outer circumferential face of the fitting-cylinder part 24, and concave parts 48 are formed on the inner face of the fixing ring 46 so as to correspond to the convex parts 47. The fixing ring 46 is formed of material that is elastically deformed in the radial direction, such as rubber, synthetic resin or the like, and fitted to the outside of the cover tube 12 while being expanded in the radial direction, with the end of the cover tube 12 fitted to the outside of the fitting-cylinder part 24.

Figure 10B:
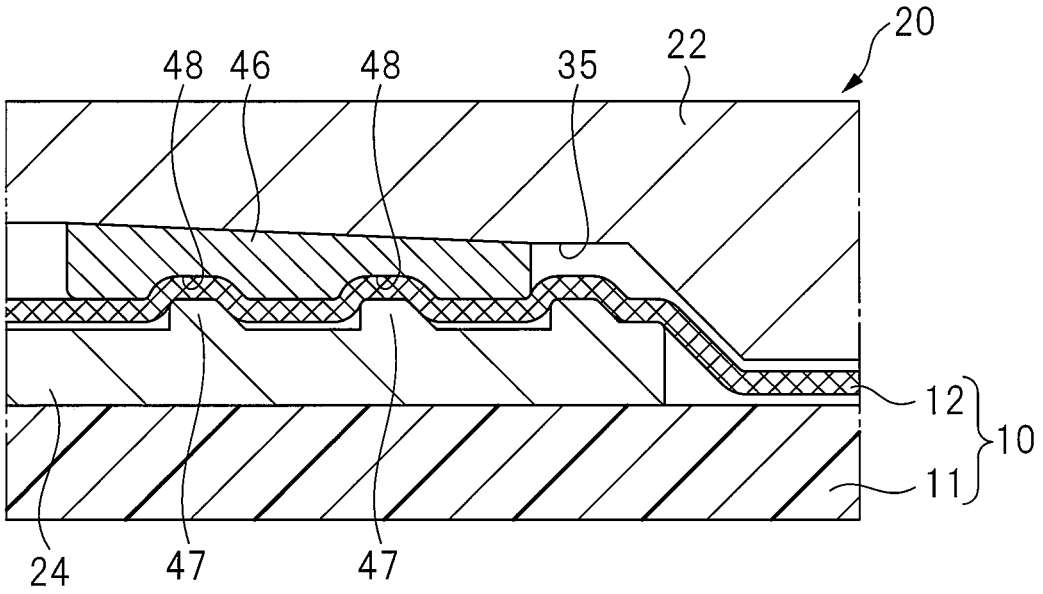
FIG. 10B is an enlarged cross sectional view partially showing a tube-fixing tool of another modified example.

In a tube-fixing tool 20 shown in FIG. 10B, the inner circumferential face 35 is a taper face whose inner diameter is gradually increased toward the end face of the cover tube 12. On the other hand, the inner circumferential face 35 shown in FIG. 10A has a straight face in parallel with the center axis "O" of the fixing sleeve 22. In this case, since the inner circumferential face 35 is formed as a taper face, the fixing sleeve 22 can be elastically deformed in a radial direction by moving the fixing sleeve 22 in the axial direction. In this manner, a fixing strength for the cover tube 12 exerted by the fixing sleeve 22 can be increased.

The fixing ring 46 shown in FIG. 9A is integrally formed in a circumferential direction. On the other hand, the fixing ring 46 may be formed into a C-shaped mode having a slit 49 extending in the axial direction as shown in FIG. 9B. In this case, the attaching work of the fixing ring 46 on the outside of the cover tube 12 can be easily carried out. Moreover, the fixing ring 46 may be made of two semicircular members. In this case, the attaching work of the fixing ring 46 on the outside of the cover tube 12 can be more easily carried out, and the fixing ring 46 can be made of hard resin or metal material. In this manner, a mode for fixing the cover tube 12 to the fixing-tool body 21 via the fixing ring 46 may be applied to the tube-fixing tool 20 shown in FIG. 4. In this case, two fixing rings 46 are respectively fitted to the first and second inner circumferential faces 35*a* and 35*b* different in inner diameters from each other.

Figure 11A:
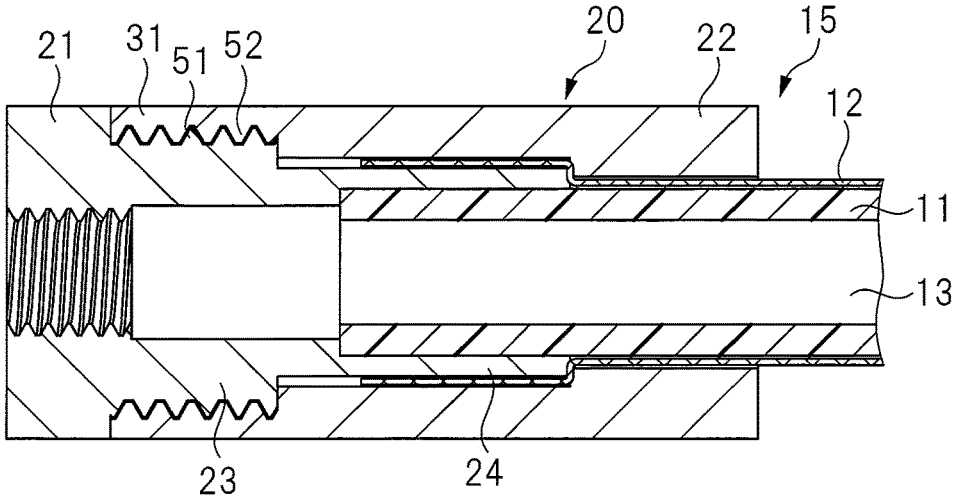
FIGS. 11A to 11C are cross sectional views each showing a tube-fixing tool of another modified example.
Figure 11B:
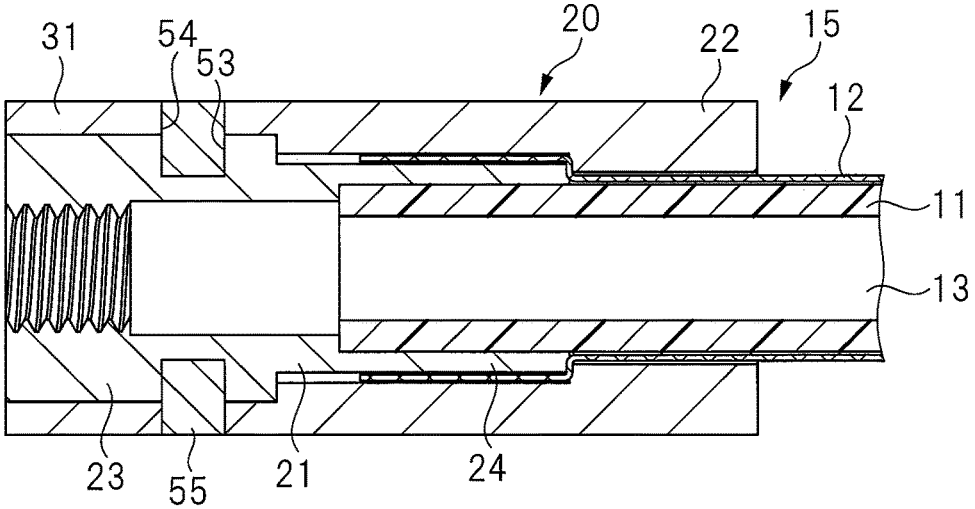
Figure 11C:
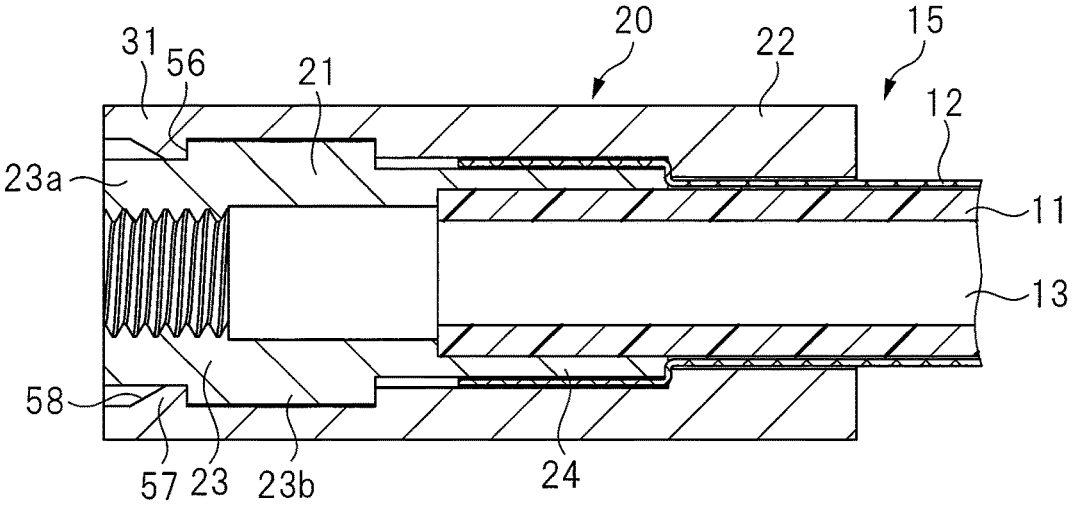

FIGS. 11A to 11C are cross sectional views each showing a tube-fixing tool of another modified example.

In the above-mentioned tube-fixing tool 20, the fixing sleeve 22 is fixed to the fixing-tool body 21 by press-inserting the fastening part 31 of the fixing sleeve 22 into the attaching part 23 of the fixing-tool body 21.

On the other hand, in a tube-fixing tool 20 shown in FIG. 11A, a male screw 51 is formed on the attaching part 23, and a female screw 52 is formed on the fastening part 3 and screw-coupled to the male screw 51. In this manner, the fixing sleeve 22 is screw-coupled to the attaching part 23.

In a tube-fixing tool 20 shown in FIG. 11B, attaching holes 53 are formed on the attaching part 23, and attaching holes 54 are formed on the fastening part 31 so as to correspond to the respective attaching holes 53. By coupling pins 55 that are press-inserted into the attaching holes 53 and 54, the fixing sleeve 22 is fixed to the attaching part 23.

In a tube-fixing tool 20 shown in FIG. 11C, the attaching part 23 has: a small diameter part 23*a* disposed on the base end side; and a large diameter part 23*b* larger in diameter than the small diameter part 23*a*. An engaging face 56 extending in the radial direction is formed between the small diameter part 23*a* and the large diameter part 23*b*. An engaging claw 57 is formed on the base end face side of the fastening part 31, and the engaging claw 57 is engaged with the engaging face 56. An inclined face 58 gradually increased in inner diameter toward the base end face of the fixing sleeve 22 is formed on the base end face side of the engaging claw 57. In FIG. 11C, by press-inserting the fixing sleeve 22 into the fixing-tool body 21 from the right side in this figure, the inclined face 58 is guided by the large diameter part 23*b*, and the engaging claw 57 is elastically deformed in a radially outward direction. Therefore, by press-inserting the fixing sleeve 22 into the fixing-tool body 21, the engaging claw 57 is engaged with the engaging face 56, and the fixing sleeve 22 is fixed to the attaching part 23.

As shown in FIG. 11, as an attaching mode of the fixing sleeve 22 to the fixing-tool body 21, a press-insertion mode, a screw coupling mode, a pin coupling mode, an engaging mode and the like may be employed. In each embodiment, the lateral cross sectional shape of the outer circumferential face of the attaching part 23 is formed into a round shape. On the other hand, this may be formed into a polygonal shape such as quadrangle, hexagon, or the like. Under the condition that the cross sectional shape of the outer circumferential face of the attaching part 23 is formed into a polygonal shape, the inner face 32 of the fastening part 31 to be fitted to the outside also has a polygonal shape. Moreover, a lateral cross sectional shape of the outer circumferential face of the fixing sleeve 22 is not limited by the round shape, a polygonal shape may be used.

The present invention is not limited by the above-mentioned embodiments, and it will be obvious to those skilled in the art that various changes may be made without departing from the scope of the invention. For example, as the elastic tube 10, any mode may be used as long as a tube having at least two layers that are freely flexibly deformed is used, and the cover tube is not limited by the knitted strand tube as long as the tube allows the outside cover tube to be expanded outward from the soft tube.

What is claimed is:

1. A tube-fixing tool to be attached to an end of an elastic tube provided with a soft tube and a cover tube which has a net-shaped structure that is formed into a tube shape by knitting fibers and which is formed on an outside of the soft tube, the tube-fixing tool comprising:

a fixing-tool body having a fitting-cylinder part provided with: a fitting-inner face that is fitted to an outer face of the soft tube; and a fitting-outer face that is fitted to an inner face of the cover tube, the fitting-cylinder part being assembled between the soft tube and the cover tube; and a fixing sleeve having: an inner circumferential face that is opposed to the fitting-cylinder part via the cover tube; a fastening part that is attached to the fixing-tool body; and a guide part that is provided to a tip end of the fixing sleeve where a guide face smaller in diameter than the inner circumferential face is formed, wherein the fixing sleeve has a first stopper face constituted by a border face between the inner circumferential face and the guide face, the fixing-tool body has a first opposing face that is opposed to the first stopper face, and a gap between the stopper face and the opposing face is smaller than a thickness of the cover tube, and the cover tube is sandwiched and fixed between the stopper face and the opposing face.

2. The tube-fixing tool according to claim 1, wherein the fitting-outer face has: a first fitting-outer face; and a second fitting-outer face that is closer to a base end of the fixing-tool body than the first fitting-outer face, and larger in diameter than the first fitting-outer face, the inner circumferential face has: a first inner circumferential face that is opposed to the first fitting-outer face; and a second inner circumferential face that is opposed to the second fitting-outer face, the fixing sleeve has a second stopper face constituted by a border face between the first inner circumferential face and the second inner circumferential face, the fixing-tool body has a second opposing face that is opposed to the second stopper face, and the cover tube is sandwiched and fixed between the first stopper face and the first opposing face, and between the second stopper face and the second opposing face.

3. The tube-fixing tool according to claim 1, wherein the opposing face and the stopper face are perpendicular to a center axis of the fixing-tool body, or one of the opposing face and the stopper face is perpendicular to the center axis of the fixing-tool body, with the other being inclined relative to the center axis.

4. The tube-fixing tool according to claim 1, wherein the opposing face is inclined relative to a center axis of the fixing-tool body, and the stopper face is opposed to the opposing face and inclined along the opposing face.

5. The tube-fixing tool according to claim 1, wherein a protruding part is formed on at least one of the opposing face and the stopper face.

6. An actuator comprising:

an elastic tube having: a soft tube; and a cover tube that is formed on an outside of the soft tube; and a tube-fixing tool according to claim 1, the tube-fixing tool being formed on an end of the elastic tube, wherein the actuator is extended and contracted by an elastic deformation in a radial direction of the elastic tube by a fluid supplied to or discharged from an inner space of the elastic tube.

* * * * *